US005823855A

United States Patent [19]

Robinson

[11] Patent Number: 5,823,855

[45] Date of Patent: Oct. 20, 1998

[54] POLISHING PAD AND A METHOD FOR MAKING A POLISHING PAD WITH COVALENTLY BONDED PARTICLES

[75] Inventor: Karl M. Robinson, Boise, Id.

[73] Assignee: Micron Technology, Inc., Boise, Id.

[21] Appl. No.: 798,001

[22] Filed: Feb. 12, 1997

Related U.S. Application Data

[62] Division of Ser. No. 589,774, Jan. 22, 1996, Pat. No. 5,624,303.

[51] Int. Cl.[6] ..... B24B 7/04

[52] U.S. Cl. ..... 451/41; 451/285; 451/286; 451/287; 451/288; 451/289

[58] Field of Search ..... 451/536, 526–528, 451/532, 285–289, 921, 41, 28; 51/293, 298, 306

[56] References Cited

U.S. PATENT DOCUMENTS

| | | | |
|---|---|---|---|
| D. 166,100 | 3/1952 | Roop | 30/147 |
| 202,757 | 4/1878 | Reese | 30/147 |
| 2,185,942 | 1/1940 | Frank | 30/147 |
| 3,617,347 | 11/1971 | Kuratomi | 117/69 |
| 4,565,771 | 1/1986 | Lynch et al. | 430/307 |
| 4,954,142 | 9/1990 | Carr et al. . | |
| 5,127,196 | 7/1992 | Morimoto et al. | 51/165.73 |
| 5,197,999 | 3/1993 | Thomas | 51/298 |
| 5,213,588 | 5/1993 | Wong et al. | 51/293 |
| 5,250,085 | 10/1993 | Mevissen | 51/298 |
| 5,433,650 | 7/1995 | Winebarger | 451/6 |
| 5,672,095 | 9/1997 | Morimoto et al. | 451/41 |

FOREIGN PATENT DOCUMENTS

| | | |
|---|---|---|
| 0227394 | 7/1987 | European Pat. Off. . |
| 02186656 | 7/1990 | European Pat. Off. . |
| 07135192 | 5/1995 | European Pat. Off. . |
| 0685877A2 | 12/1995 | European Pat. Off. . |
| WO94/04599 | 3/1994 | WIPO . |

*Primary Examiner*—Robert A. Rose
*Assistant Examiner*—George Nguyen
*Attorney, Agent, or Firm*—Seed and Berry LLP

[57] ABSTRACT

The present invention is a polishing pad for use in chemical-mechanical planarization of semiconductor wafers, and a method for making the polishing pad. The polishing pad has a body, molecular bonding links, and abrasive particles dispersed substantially uniformly throughout the body. The body is made from a polymeric matrix material and the molecular bonding links are covalently bonded to the matrix material. Substantially all of the abrasive particles are covalently bonded to at least one molecular bonding link. The molecular bonding links securely affix the abrasive particles to the matrix material to enhance the uniformity of the distribution of the abrasive particles throughout the pad and to substantially prevent the abrasive particles from breaking away from the pad.

25 Claims, 2 Drawing Sheets

POLISHING PAD AND A METHOD FOR MAKING A POLISHING PAD WITH COVALENTLY BONDED PARTICLES

CROSS-REFERENCE TO RELATED APPLICATION

This application is a divisional of U.S. patent application Ser. No. 08/589,774, filed Jan. 22, 1996 now U.S. Pat. No. 5,624,303.

TECHNICAL FIELD

The present invention relates to polishing pads used in chemical-mechanical planarization of semiconductor wafers, and, more particularly, to polishing pads with abrasive particles embedded in the body of the pad.

BACKGROUND OF THE INVENTION

Chemical-mechanical planarization ("CMP") processes remove materials from the surface layer of a wafer in the production of ultra-high density integrated circuits. In a typical CMP process, a wafer presses against a polishing pad in the presence of a slurry under controlled chemical, pressure, velocity, and temperature conditions. The slurry solution has abrasive particles that abrade the surface of the wafer, and chemicals that oxidize and/or etch the surface of the wafer. Thus, when relative motion is imparted between the wafer and the pad, material is removed from the surface of the wafer by the abrasive particles (mechanical removal) and by the chemicals in the slurry (chemical removal).

CMP processes must consistently and accurately produce a uniform, planar surface on the wafer because it is important to accurately focus optical or electromagnetic circuit patterns on the surface of the wafer. As the density of integrated circuits increases, it is often necessary to accurately focus the critical dimensions of the photo-pattern to within a tolerance of approximately 0.5 $\mu$m. Focusing the photo-patterns to such small tolerances, however, is very difficult when the distance between the emission source and the surface of the wafer varies because the surface of the wafer is not uniformly planar. In fact, several devices may be defective on a wafer with a non-uniform planar surface. Thus, CMP processes must create a highly uniform, planar surface.

In the competitive semiconductor industry, it is also desirable to maximize the throughput of the finished wafers and minimize the number of defective or impaired devices on each wafer. The throughput of CMP processes is a function of several factors, one of which is the rate at which the thickness of the wafer decreases as it is being planarized (the "polishing rate") without sacrificing the uniformity of the planarity of the surface of the wafer. Accordingly, it is desirable to maximize the polishing rate within controlled limits.

The polishing rate of CMP processes may be increased by increasing the proportion of abrasive particles in the slurry solution. Yet, one problem with increasing the proportion of abrasive particles in colloidal slurry solutions is that the abrasive particles tend to flocculate when they are mixed with some desirable oxidizing and etching chemicals. Although stabilizing chemicals may prevent flocculation of the abrasive particles, the stabilizing chemicals are generally incompatible with the oxidizing and etching chemicals. Thus, it is desirable to limit the proportion of abrasive particles in the slurry solution.

One desirable solution for limiting the proportion of abrasive particles in the slurry is to suspend the abrasive particles in the pad. Conventional suspended particle pads are made by admixing the abrasive particles into a matrix material made from monomer chains. An ionic adhesion catalyst, such as hexamethyldisalizane, may be used to enhance adhesion between the particles and the monomer chains. After the abrasive particles are mixed into the matrix material, the matrix material is cured to harden the pad and suspend the abrasive particles throughout the matrix material. In operation, the suspended abrasive particles in the pad abrade the surface of the wafer to mechanically remove material from the wafer.

One problem with conventional suspended particle polishing pads is that the abrasiveness of the planarizing surface of the pad, and thus the polishing rate of a wafer, varies from one area to another across the surface of the pad. Before the matrix material is cured, the abrasive particles commonly agglomerate into high density clusters, causing a non-uniform distribution of abrasive particles throughout the pad. Therefore, it would be desirable to develop a suspended particle polishing pad with a uniform distribution of abrasive particles throughout the pad.

Another problem with conventional suspended particle polishing pads is that they tend to scratch the surface of the wafer. As the pad planarizes a wafer, the matrix material adjacent to abrasive particles on the planarizing surface of the polishing pad wears down; eventually, some of the abrasive particles break away from the pad and travel in the slurry. Particles also break away from pads with ionic adhesion catalysts because electrostatic solvents weaken the ionic bonds between the matrix material and the particles. When a large agglomeration of suspended particles breaks away from the pad, it may scratch the surface of the wafer and seriously damage several of the devices on the wafer. Therefore, it would be desirable to develop a pad that substantially prevents abrasive particles from breaking away from the pad.

SUMMARY OF THE INVENTION

The inventive polishing pad is used for planarizing semiconductor wafers with a CMP process; the polishing pad has a body, molecular bonding links, and abrasive particles dispersed substantially uniformly throughout the body. The body is made from a polymeric matrix material, and the molecular bonding links are covalently attached to the matrix material. Substantially all of the abrasive particles are also covalently bonded to at least one molecular bonding link. The molecular bonding links securely affix the abrasive particles to the matrix material to enhance the uniformity of the distribution of the abrasive particles throughout the pad and to substantially prevent the abrasive particles from breaking away from the pad.

In a method for making the inventive bonded particle polishing pad, molecular bonding links are covalently bonded to abrasive particles. After the molecular bonding links are covalently bonded to the abrasive particles, the bonded molecular bonding links and abrasive particles are admixed with a matrix material in a mold. During the admixing step, reactive terminus groups of the molecular bonding links bond to the matrix material to securely affix the particles to the matrix material. The matrix material is then polymerized to form a pad body with bonded abrasive particles that are suspended substantially uniformly throughout the body.

DETAILED DESCRIPTION OF THE INVENTION

The polishing pad of the present invention has a uniform distribution of abrasive particles throughout the pad, and the abrasive particles are covalently bonded to the pad to substantially prevent the abrasive particles from breaking away from the pad. An important aspect of the present invention is to provide molecular bonding links that covalently bond to both the matrix material of the polishing pad and the abrasive particles. The molecular bonding links perform the following advantageous functions: (1) substantially prevent the abrasive particles from agglomerating before the matrix material is cured; and (2) secure the abrasive particles to the matrix material. The molecular bonding links, therefore, enhance the uniformity of the distribution of the abrasive particles throughout the matrix material and substantially prevent the abrasive particles from breaking away from the polishing pad.

Figure 1:
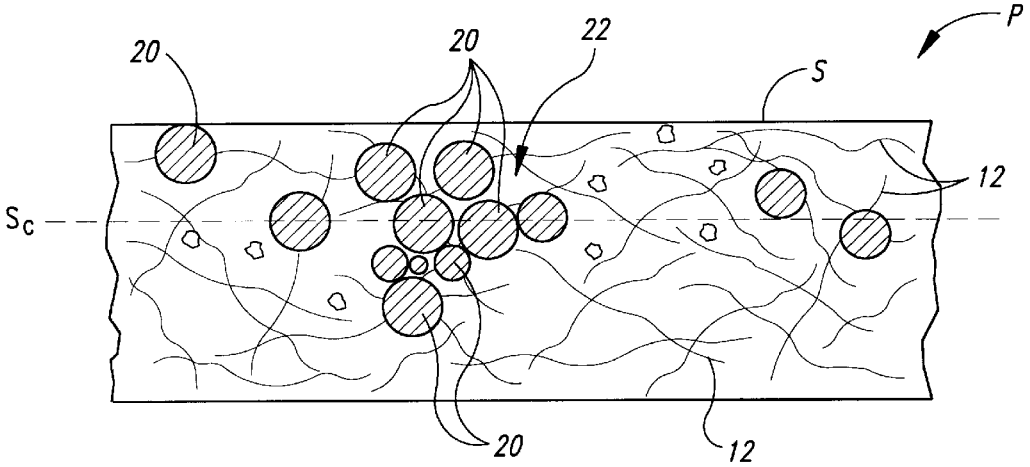
Fig. 1 (PRIOR ART)
FIG. 1 is a partial cross-sectional view of a conventional polishing pad with suspended abrasive particles in accordance with the prior art.

FIG. 1 illustrates a conventional polishing pad P formed from a matrix material 12 and a number of abrasive particles 20. The abrasive particles 20 are suspended in the matrix material 12 while the matrix material 12 is in a liquid state. Before the matrix material 12 cures, the abrasive particles 20 may agglomerate into clusters 22 that reduce the uniformity of the distribution of the abrasive particles 20 throughout the matrix material 12. Thus, when a planarizing surface S of the pad P is conditioned to a new planarizing surface $S_c$, the polishing rate over the cluster 22 of abrasive particles 20 is different than that of other areas on the pad. Additionally, as the matrix material 12 wears down during planarization or conditioning, abrasive particles 20 near the planarizing surface tend to break away from the pad P and scratch a wafer (not shown). Thus, conventional suspended particle polishing pads may provide erratic polishing rates and damage the wafers.

Figure 2:
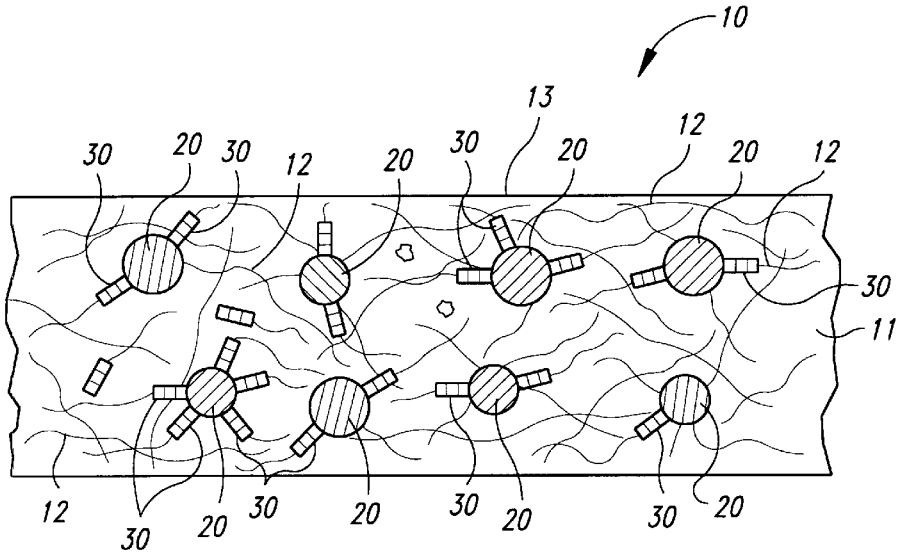
FIG. 2 is a partial schematic cross-sectional view of a polishing pad with bonded, suspended particles in accordance with the invention.

FIG. 2 illustrates a polishing pad 10 in accordance with the invention. The polishing pad 10 has a body 11 made from a matrix material 12. The matrix material 12 is generally polyurethane or nylon. The above-listed polymeric materials are merely exemplary, and thus other polymeric matrix materials are within the scope of the invention. The molecular bonding links 30 covalently bond to the matrix material 12 and the abrasive particles 20. The molecular bonding links 30, therefore, secure the abrasive particles 20 to the matrix material 12. The abrasive particles 20 are preferably made from silicon dioxide or aluminum oxide, but other types of abrasive particles are within the scope of the invention.

Figure 3:
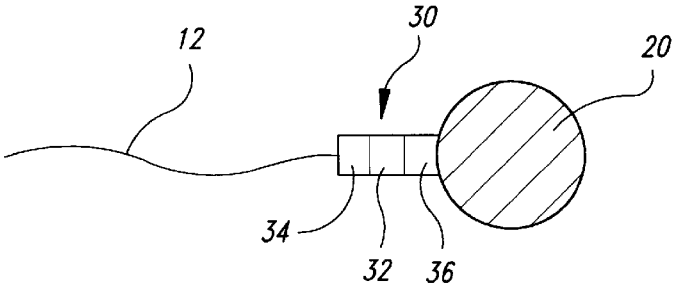
FIG. 3 is a schematic view of a molecular bonding link and an abrasive particle in accordance with the invention.

FIG. 3 further illustrates the bond between a strand of matrix material 12, a bonding link 30, and an abrasive particle 20. The molecular bonding link 30 has an alkyl chain 32, a reactive terminus group 34, and a particle affixing group 36. The reactive terminus group 34 is a molecular segment that bonds the bonding link 30 to the strand of the matrix material 12. The specific structure of the reactive terminus group 34 is selected to reactively bond with the specific type of matrix material 12 when the matrix material 12 is in a liquid monomer phase. The particle affixing group 36 is another molecular segment that covalently bonds the bonding link 30 to the abrasive particle 20. The specific structure of the particle affixing group 36 is similarly selected to covalently bond with the material from which the abrasive particles 20 are made. Accordingly, the molecular bonding link 30 securely attaches the abrasive particle 20 to the matrix material 12.

Figure 4A:
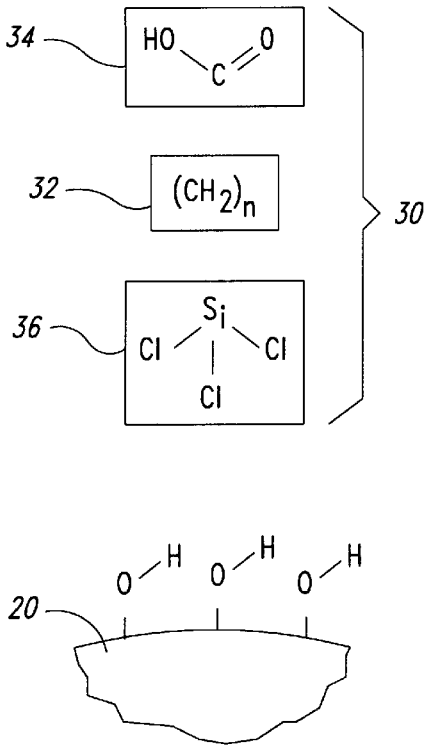
FIG. 4A is a chemical diagram of a molecular bonding link and abrasive particle in accordance with the invention.
Figure 4B:
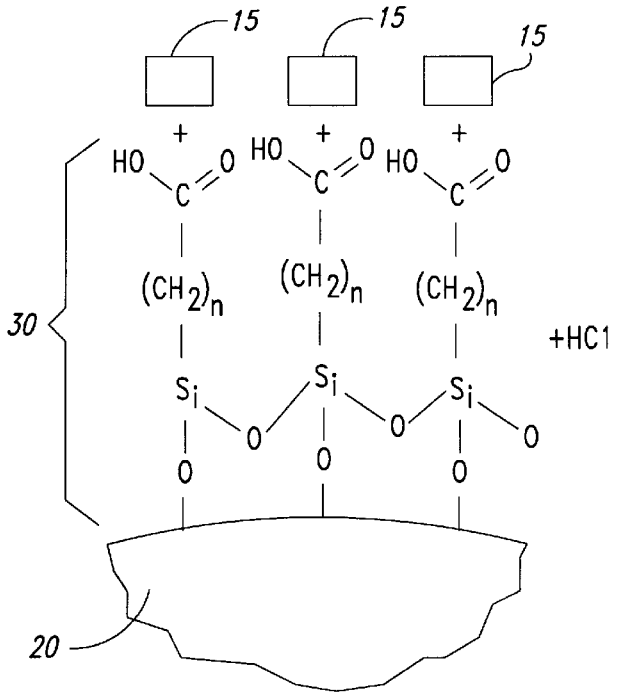
FIG. 4B is a chemical diagram of the reaction between a molecular bonding link and an abrasive particle in accordance with the invention.

FIG. 4A illustrates a specific embodiment of the molecular bonding link 30. The alkyl chain 32 is made from $(CH_2)_n$, where n=1–30, the reactive terminus group is made from COOH, and the particle affixing group is made from trichlorosilane. Referring to FIG. 4B, the trichlorosilane molecule reacts with the O—H chains on the surface of the particle 20 to covalently bond the abrasive particle 20 to the particle affixing group 36 of the molecular bonding link 30. Similarly, the COOH reactive terminus group 34 reacts with a urethane monomer chain 12 to bond the bonding link 30 to the matrix material 12. The byproducts of the reaction are water and hydrochloric acid.

The invention is not limited to abrasive particles made from silicon dioxide or a matrix material made from polyurethane. The materials from which the abrasive particles and the matrix material are made can be varied to impart desired characteristics to the pad. A central aspect of the invention is to select molecular bonding links that covalently bond to the abrasive particles and matrix material to substantially prevent the bonds between the matrix material, molecular bonding links, and abrasive particles from weakening in the presence of an electrostatic solvent. Additionally, the length of the alkyl chain 32 of the molecular bonding link 30 may be varied to accommodate different sizes of abrasive particles 20. For example, an alkyl chain 15–20 Å in length (approximately twelve carbon atoms $(CH_2)_{12}$) may be used with a 1,500 Å diameter particle. Longer alkyl chains 32 are preferably used with larger abrasive particles 20, and shorter alkyl chains 32 are preferably used with smaller abrasive particles 20.

As described above, the polishing pad 10 is used for planarizing semiconductor wafers with a CMP process. For example, in one method of planarizing a wafer or other microelectronic substrate in accordance with the invention, a wafer is pressed against the polishing pad 10 in the presence of a slurry under controlled chemical, pressure, velocity and temperature conditions. At least one of the wafer or the pad 10 is then moved relative to the other to impart relative motion therebetween. As the pad 10 moves with respect to the wafer, the abrasive particles 20 at the planarizing surface of the pad 10 abrade the wafer to mechanically remove material from the wafer. Additionally, chemicals in the slurry may also chemically remove material from the wafer.

Figure 5:
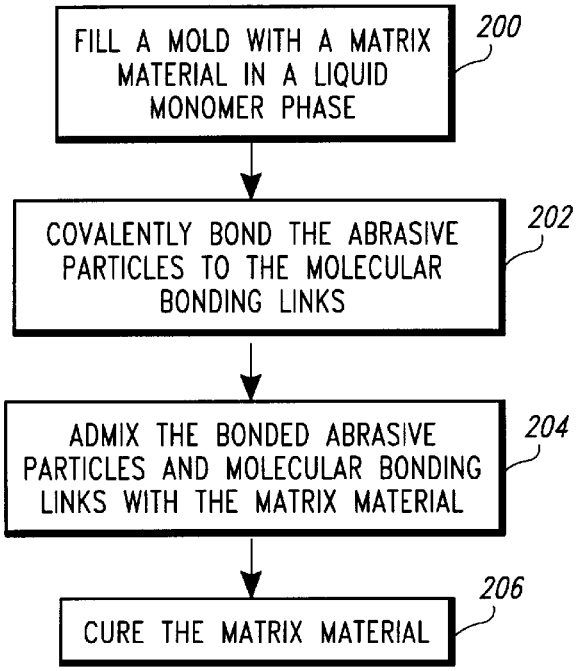
FIG. 5 is a flow chart illustrating a method of making a polishing pad with bonded, suspended particles in accordance with the invention.

FIG. 5 graphically illustrates a method for making bonded particle polishing pads for use in chemical-mechanical planarization of semiconductor wafers in accordance with the invention. The first step 200 of the method is to fill a mold with a matrix material in a liquid monomer phase. The second step 202 is to covalently bond abrasive particles to molecular bonding links. Depending upon the desired length of the molecular bonding links, they are deposited onto the abrasive particles either by vapor deposition (shorter lengths) or by liquid deposition (longer lengths). The third step 204 is to admix the bonded molecular bonding links and abrasive particles with the matrix material. The pad is made from approximately 10%–50% by weight abrasive particles and bonding links, and approximately 50%–90% by weight matrix material 12. In a preferred embodiment, the pad is made from approximately 15%–25% by weight of bonded abrasive particles and bonding links. After the bonded abrasive particles and molecular bonding links are disbursed substantially uniformly throughout the matrix material, the fourth step 206 is to cure the matrix material.

One advantage of the present invention is that the polishing pad results in a high polishing rate without limiting the oxidizing or etching chemicals in the slurry. By putting the abrasive particles 20 in the pad 10, stabilizing agents are not required in the slurry solution. Accordingly, a wider range of etching and oxidizing chemicals may be used in the slurry solution.

Another advantage of the present invention is that the polishing pad 10 has a uniform polishing rate across its planarizing surface. By bonding the abrasive particles 20 to the matrix material 12, the abrasive particles 20 do not agglomerate into large clusters 22, as shown in FIG. 1. The polishing pad 10, therefore, has a substantially uniform distribution of abrasive particles 20 throughout the matrix material. Thus, the polishing rate is substantially uniform across the surface of the wafer.

Still another advantage of the invention is that the polishing pad 10 does not create large scratches on the surface of a wafer. By covalently bonding the abrasive particles 20 to the matrix material 12, the abrasive particles 20 do not readily break away from the pad 10 in the presence of an electrostatic solvent. Thus, compared to conventional pads, large clusters 22 of abrasive particles 20 are less likely to break away from the pad 10 and scratch a wafer during planarization.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method of planarizing a semiconductor wafer, comprising removing material from the substrate with an abrasive polishing pad that has a body made from a matrix material, abrasive particles, and bonding molecules affixing the abrasive particles to the matrix material in manner capable of substantially maintaining the affixation between the abrasive particles and the matrix material in the presence of an electrostatic chemical-mechanical planarization slurry.

2. The method of claim 1 wherein the removing step further comprises pressing the semiconductor wafer against the polishing pad and moving at least one of the semiconductor wafer and the polishing pad with respect to the other to impart relative motion therebetween.

3. The method of claim 1 wherein the removing step further comprises:

depositing a slurry on the polishing pad;

pressing the semiconductor wafer against the polishing pad in the presence of the slurry; and moving at least one of the semiconductor wafer and the polishing pad with respect to the other to impart relative motion therebetween.

4. The method of claim 3 wherein abrasive particles comprise silicon dioxide, and wherein the moving step comprises abrading the semiconductor wafer with at least a portion of the silicon dioxide abrasive particles.

5. The method of claim 3 wherein the abrasive particles comprise aluminum oxide, and wherein the moving step comprises abrading the semiconductor wafer with at least a portion of the aluminum oxide abrasive particles.

6. The method of claim 3 wherein the abrasive particles comprise an oxide, and wherein the moving step comprises abrading the semiconductor wafer with at least a portion of the oxide abrasive particles.

7. The method of claim 3 wherein the abrasive particles comprise approximately 10% to 50% of the polishing pad by weight, and the moving step comprises abrading the semiconductor wafer with at least a portion of the abrasive particles at a planarizing surface of the polishing pad.

8. The method of claim 3 wherein the abrasive particles have an average particle size of approximately 0.15 $\mu$m, and the moving step comprises abrading the substrate with at least a portion of the abrasive particles at a planarizing surface of the polishing pad.

9. The method of claim 3 wherein the abrasive particles have an average particle size of less than approximately 0.15 $\mu$m, and the moving step comprises abrading the substrate with at least a portion of the abrasive particles at a planarizing surface of the polishing pad.

10. A method of planarizing a semiconductor wafer, comprising the steps of:

pressing the semiconductor wafer onto a polishing pad having a body made from a polymeric matrix material, abrasive particles, and bonding molecules, each bonding molecule of the polishing pad having a reactive terminus group for covalent bonding to the matrix material and a particle affixing group for covalent bonding to an abrasive particle, wherein bonds between the particle affixing groups and the abrasive particles affix the abrasive particles to the matrix material in a manner capable of substantially maintaining the affixation between the abrasive particles and the matrix material in the presence of an electrostatic slurry; and moving at least one of the semiconductor wafer and the polishing pad with respect to the other to impart relative motion therebetween.

11. The method of claim 10 wherein the removing step further comprises:

depositing a slurry on the polishing pad; and pressing the semiconductor wafer against the polishing pad in the presence of the slurry.

12. The method of claim 10 wherein the abrasive particles comprise silicon dioxide, and wherein the moving step comprises abrading the semiconductor wafer with at least a portion of the silicon dioxide abrasive particles.

13. The method of claim 10 wherein the abrasive particles comprise aluminum oxide, and wherein the moving step comprises abrading the semiconductor wafer with at least a portion of the aluminum oxide abrasive particles.

14. The method of claim 10 wherein the abrasive particles comprise an oxide, and wherein the moving step comprises abrading the semiconductor wafer with at least a portion of the oxide abrasive particles.

15. The method of claim 10 wherein the abrasive particles comprise approximately 10% to 50% of the polishing pad by weight, and the moving step comprises abrading the semiconductor wafer with at least a portion of the abrasive particles at a planarizing surface of the polishing pad.

16. The method of claim 10 wherein the abrasive particles have an average particle size of approximately 0.15 $\mu$m, and the moving step comprises abrading the substrate with at least a portion of the abrasive particles at a planarizing surface of the polishing pad.

17. A method of planarizing a semiconductor wafer, comprising abrading material from the semiconductor wafer with a polishing pad having a body made from a matrix material, abrasive particles, and bonding molecules affixing the abrasive particles to the matrix material, each bonding molecule having a reactive terminus group to covalently bond the bonding molecule to the matrix material and a non-hydrolyzed particle affixing group to covalently bond the bonding molecule to an abrasive particle, wherein the bonding molecules affix the abrasive particles to the matrix material in manner capable of substantially maintaining the affixation between the abrasive particles and the matrix material in the presence of an electrostatic chemical-mechanical planarization slurry.

18. The method of claim 17 wherein the removing step further comprises pressing the semiconductor wafer against the polishing pad and moving at least one of the semiconductor wafer and the polishing pad with respect to the other to impart relative motion therebetween.

19. The method of claim 17 wherein the removing step further comprises:

depositing a slurry on the polishing pad;

pressing the semiconductor wafer against the polishing pad in the presence of the slurry; and moving at least one of the semiconductor wafer and the polishing pad with respect to the other to impart relative motion therebetween.

20. The method of claim 19 wherein abrasive particles comprise silicon dioxide, and wherein the moving step comprises engaging the semiconductor wafer with at least a portion of the silicon dioxide abrasive particles.

21. The method of claim 19 wherein the abrasive particles comprise aluminum oxide, and wherein the moving step comprises engaging the semiconductor wafer with at least a portion of the aluminum oxide abrasive particles.

22. The method of claim 19 wherein the abrasive particles comprise an oxide, and wherein the moving step comprises engaging the semiconductor wafer with at least a portion of the oxide abrasive particles.

23. The method of claim 19 wherein the abrasive particles comprise approximately 10% to 50% of the polishing pad by weight, and the moving step comprises engaging the semiconductor wafer with at least a portion of the abrasive particles at a planarizing surface of the polishing pad.

24. The method of claim 19 wherein the abrasive particles have an average particle size of approximately 0.15 $\mu$m, and the moving step comprises engaging the substrate with at least a portion of the abrasive particles at a planarizing surface of the polishing pad.

25. The method of claim 19 wherein the abrasive particles have an average particle size of less than approximately 0.15 $\mu$m, and the moving step comprises engaging the substrate with at least a portion of the abrasive particles at a planarizing surface of the polishing pad.

* * * * *

UNITED STATES PATENT AND TRADEMARK OFFICE

CERTIFICATE OF CORRECTION

PATENT NO. : 5,823,855

DATED : October 20, 1998

INVENTOR(S) : Karl M. Robinson

It is certified that error appears in the above-identified patent and that said Letters Patent is hereby corrected as shown below:

| | Reads | Should Read |
|---|---|---|
| Column 5, line 47 | "in manner" | - - in a manner - - |

Signed and Sealed this

First Day of May, 2001

*Attest:*

Nicholas P. Godici

NICHOLAS P. GODICI

*Attesting Officer*

*Acting Director of the United States Patent and Trademark Office*